US009668557B2

(12) United States Patent
Webster

(10) Patent No.: US 9,668,557 B2
(45) Date of Patent: Jun. 6, 2017

(54) PROTECTIVE CASES

(71) Applicant: Connie France Webster, Chesterton, IN (US)

(72) Inventor: Connie France Webster, Chesterton, IN (US)

( * ) Notice: Subject to any disclaimer, the term of this patent is extended or adjusted under 35 U.S.C. 154(b) by 0 days.

(21) Appl. No.: 14/965,239

(22) Filed: Dec. 10, 2015

(65) Prior Publication Data

US 2016/0166026 A1 Jun. 16, 2016

Related U.S. Application Data

(60) Provisional application No. 62/089,960, filed on Dec. 10, 2014.

(51) Int. Cl.

| | |
|---|---|
| ***A45C 11/00*** | (2006.01) |
| ***A45C 5/06*** | (2006.01) |
| ***A45C 5/02*** | (2006.01) |
| ***A45C 5/03*** | (2006.01) |
| ***A45C 13/10*** | (2006.01) |
| *A45C 13/02* | (2006.01) |

(52) U.S. Cl.

CPC ..... *A45C 11/00* (2013.01); *A45C 5/02* (2013.01); *A45C 5/03* (2013.01); *A45C 5/06* (2013.01); *A45C 13/103* (2013.01); *A45C 2011/003* (2013.01); *A45C 2013/025* (2013.01); *A45C 2200/10* (2013.01)

(58) Field of Classification Search

CPC .. A45C 5/02; A45C 5/06; A45C 13/02; A45C 2011/003; A45C 2013/025; A45C 11/00

USPC ..... 206/320, 521; 190/125

See application file for complete search history.

(56) References Cited

U.S. PATENT DOCUMENTS

| | | | | |
|---|---|---|---|---|
| 3,506,049 | A | 4/1970 | Gerard | |
| 5,143,133 | A | 9/1992 | Speckman | |
| 6,446,809 | B2 * | 9/2002 | Flynn | A45C 5/02 190/125 |
| 7,036,642 | B2 * | 5/2006 | Hoberman | A45C 13/02 190/109 |
| 7,467,695 | B2 * | 12/2008 | Gormick | A45C 3/02 190/102 |
| 8,225,928 | B2 * | 7/2012 | Perrier | A45C 11/00 206/305 |
| 8,353,400 | B2 * | 1/2013 | Santy | 190/102 |
| 2005/0258057 | A1 * | 11/2005 | Gelphman | A45C 13/02 206/320 |
| 2007/0056865 | A1 * | 3/2007 | Pelo | A45C 13/02 206/320 |

(Continued)

*Primary Examiner* — Steven A. Reynolds

(74) *Attorney, Agent, or Firm* — Hartman Global IP Law; Gary M. Hartman; Michael D. Winter

(57) ABSTRACT

Protective cases for transporting a planar-shaped object includes a body including side, front, rear, and bottom walls coupled at edges thereof to define a housing having a cavity therein, an opening defined by uppermost edges of the side, front, and rear walls, and a lid secured to at least one of the uppermost edges of the side, front, and rear walls. The side, front, and rear walls and the lid each comprise a multilayer construction including an exterior layer, an interior layer, and at least one protective layer enclosed therebetween. The side, front, and rear walls include at least an impact-absorbing layer and optionally a rigid layer, and the lid includes at least an impact-absorbing layer.

20 Claims, 5 Drawing Sheets

(56) References Cited

U.S. PATENT DOCUMENTS

2007/0251846 A1* 11/2007 Brim, III ..... A45C 13/02
206/320
2011/0272305 A1* 11/2011 Lee ..... A45C 5/03
206/320

* cited by examiner

PROTECTIVE CASES

CROSS REFERENCE TO RELATED APPLICATIONS

This application claims the benefit of U.S. Provisional Application No. 62/089,960, filed Dec. 10, 2014, the contents of which are incorporated herein by reference.

BACKGROUND OF THE INVENTION

The present invention generally relates to cases configured to transport and protect relatively fragile devices. The invention particularly relates to cases configured to provide impact and twist protection to devices having display screens that are exposed and/or have relatively limited impact protection, nonlimiting examples of which include flat screen televisions, flat screen computer monitors, laptop computers, computer tablets, and the like.

In the past, televisions and computer monitors were often large, heavy devices with curved screens that were not routinely transported between locations and, if they were transported, were moderately robust. However, modern flat screen televisions and computer monitors are generally much lighter than their predecessors and can often be transported by a single person with minimal difficulty. Consequently, it has become commonplace for these devices to be used, for example, for displaying information at conventions, seminars, and the like, and therefore are transported between locations on a more regular basis.

Flat screen televisions, flat screen computer monitors, laptop computers, computer tablets and the like, collectively referred to herein as flat-screen devices, generally have rectangular outer shapes and parallelepiped forms. Due to the desire for a large flat display screen, flat-screen devices typically have proportionally large widths and lengths relative to their thickness, resulting in what will be referred to herein as a planar shape or planar-shaped as a matter of convenience, though it should be understood that this term is a generalization of the three-dimensional shape of typical flat-screen devices. Often, the display screen of the flat-screen devices covers a majority of one side of the device such that the display screen is as large as possible while ensuring that the device itself is as thin as possible. As such, it is well known that display screens can be severely damaged due to relatively minor impacts or twisting of the device. Although flat-screen devices can be expensive, there are few commercial products available that are specifically configured to provide protection during transportation.

In view of the above, it can be appreciated that it would be desirable if an improved case were available for transporting and storing fragile objects having substantially planar shapes, including devices with flat display screens, and particularly cases capable of providing impact and twist protection to fragile planar-shaped devices during transportation and storage.

BRIEF DESCRIPTION OF THE INVENTION

The present invention provides protective cases suitable for transportation and storage of fragile planar-shaped objects while providing impact and twist protection for the objects.

According to a one aspect of the invention, a protective case for transporting and storing a planar-shaped object includes a body including a first side wall, a second side wall spaced apart from the first side wall, a front wall, a rear wall spaced apart from the front wall, and a bottom wall coupled to the first and second side walls, front wall, and rear wall at edges thereof to define a parallelepiped-shaped housing having a cavity therein. The case includes an opening at an end of the body oppositely-disposed from the bottom wall and defined by uppermost edges of the first side wall, the second side wall, the front wall, and the rear wall. The case further includes a lid secured to at least one of the uppermost edges and configured to close the opening and secure the planar-shaped object therein. The first side wall, the second side wall, the front wall, the rear wall, the bottom wall, and the lid each comprise a multilayer construction including an exterior layer, an interior layer, and at least one protective layer enclosed therebetween. The protective layer comprises at least one impact-absorbing layer configured to cushion the planar-shaped object and optionally comprises a rigid layer configured to increase the rigidity of the protective case. The protective layers of the first side wall, the second side wall, the front wall, the rear wall, and the bottom wall include at least the rigid layer and the impact-absorbing layer, and the protective layer of the lid includes at least the impact-absorbing layer.

According to another aspect of the invention, a protective case for transporting and storing a planar-shaped object includes a body including a first side wall, a second side wall spaced apart from the first side wall, a front wall, a rear wall spaced apart from the front wall, and a bottom wall coupled to the first and second side walls, front wall, and rear wall at edges thereof to define a parallelepiped-shaped housing having a cavity therein. The case includes an opening at an end of the body oppositely-disposed from the bottom wall and defined by uppermost edges of the first side wall, the second side wall, the front wall, and the rear wall. The case further includes a lid secured to at least one of the uppermost edges and configured to close the opening and secure the planar-shaped object therein. The first side wall, the second side wall, the front wall, the rear wall, the bottom wall, and the lid each comprise a multilayer construction including an exterior layer, an interior layer, and at least one protective layer enclosed therebetween. The protective layer comprises at least one impact-absorbing layer configured to cushion the planar-shaped object and optionally comprises a rigid layer configured to increase the rigidity of the protective case. The protective layers of the first side wall, the second side wall, the front wall, the rear wall, and the bottom wall include at least the rigid layer and the impact-absorbing layer, and the protective layer of the lid includes at least the impact-absorbing layer. A majority of forces externally applied to the protective case are distributed among the rigid layers of the first side wall, the second side wall, the front wall, the rear wall, and the bottom wall rather than to the planar-shaped object.

A technical effect of the invention is that a planar-shaped object, such as a flat-screen device, may be transported between locations with a reduced likelihood of damage to the object. In particular, it is believed that, by selectively locating combinations of impact-absorbing layers and rigid layers in the walls of the protective case, external forces applied to the case will have a reduced effect on a planar-shaped object stored therein.

Other aspects and advantages of this invention will be better appreciated from the following detailed description.

DETAILED DESCRIPTION OF THE INVENTION

Figure 4:
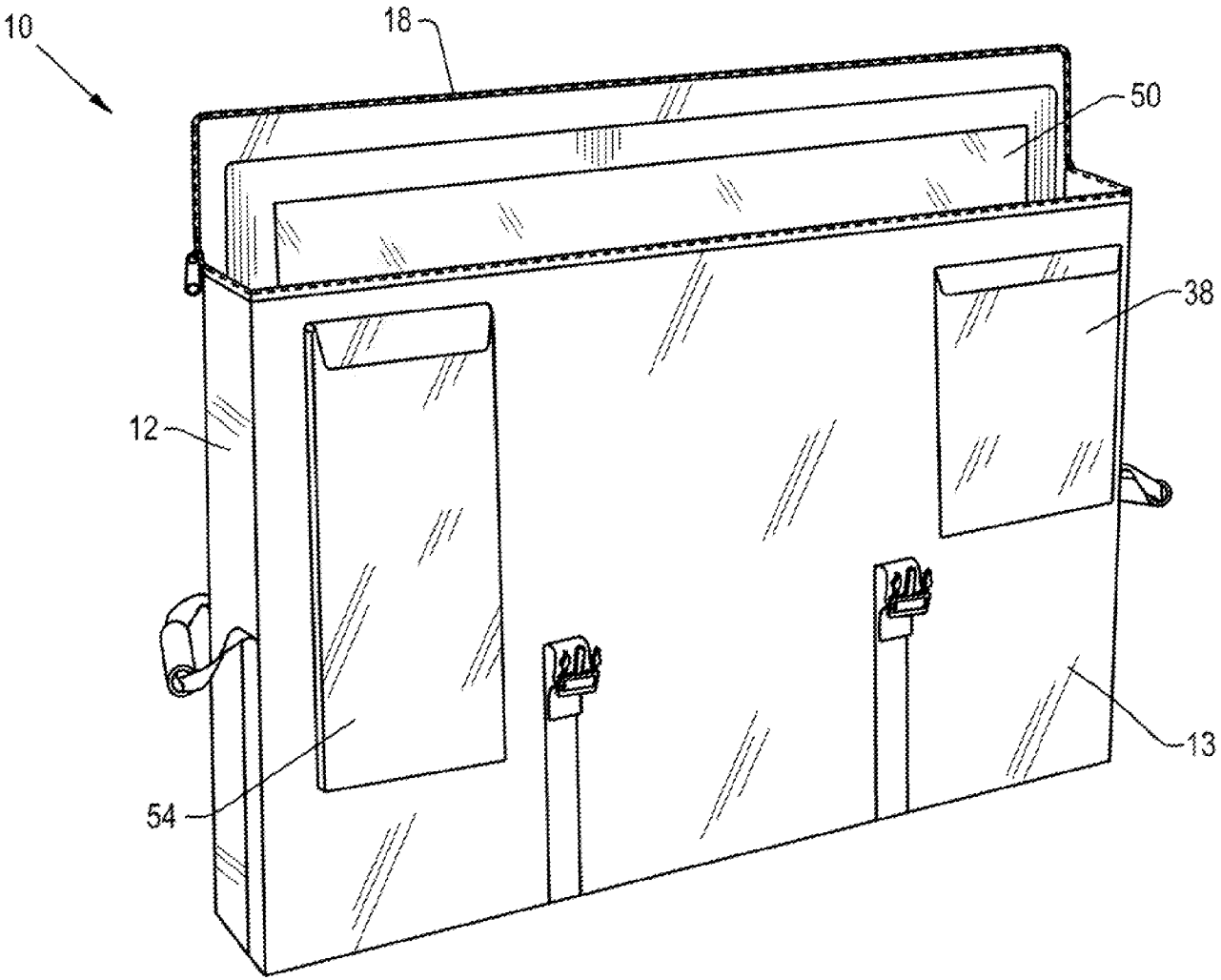
FIGS. 4 and 5 are images showing protective cases in accordance with additional aspects of this invention.

The present invention is generally related to the transportation and protection of relatively fragile planar-shaped objects, nonlimiting examples of which include flat screen televisions, flat screen computer monitors, laptop computers, computer tablets, and other flat-screen devices having display screens that are exposed and/or have relatively limited impact protection. In particular, aspects of the invention will be hereinafter described in reference to a protective case 10 configured to provide impact and twist protection to flat-screen devices (LCD, plasma, LED, etc.), for example, a television 50 seen in FIG. 4. However, the invention is not limited to such articles, and can find use when transporting or storing such fragile objects as electrical devices, glassware, etc.

To facilitate the description of the protective case 10 provided below, the terms "vertical," "horizontal," "lateral," "front," "rear," "side," "forward," "rearward," "upper," "lower," "above," "below," "right," "left," etc., will be used in reference to the perspective of the orientation of the protective case 10 in FIGS. 1 and 2, and therefore are relative terms and should not be otherwise interpreted as limitations to the construction and use of the protective case 10 or as limiting the scope of the invention. For convenience, consistent reference numbers are used throughout the drawings to identify the same or functionally equivalent elements.

Figure 1:
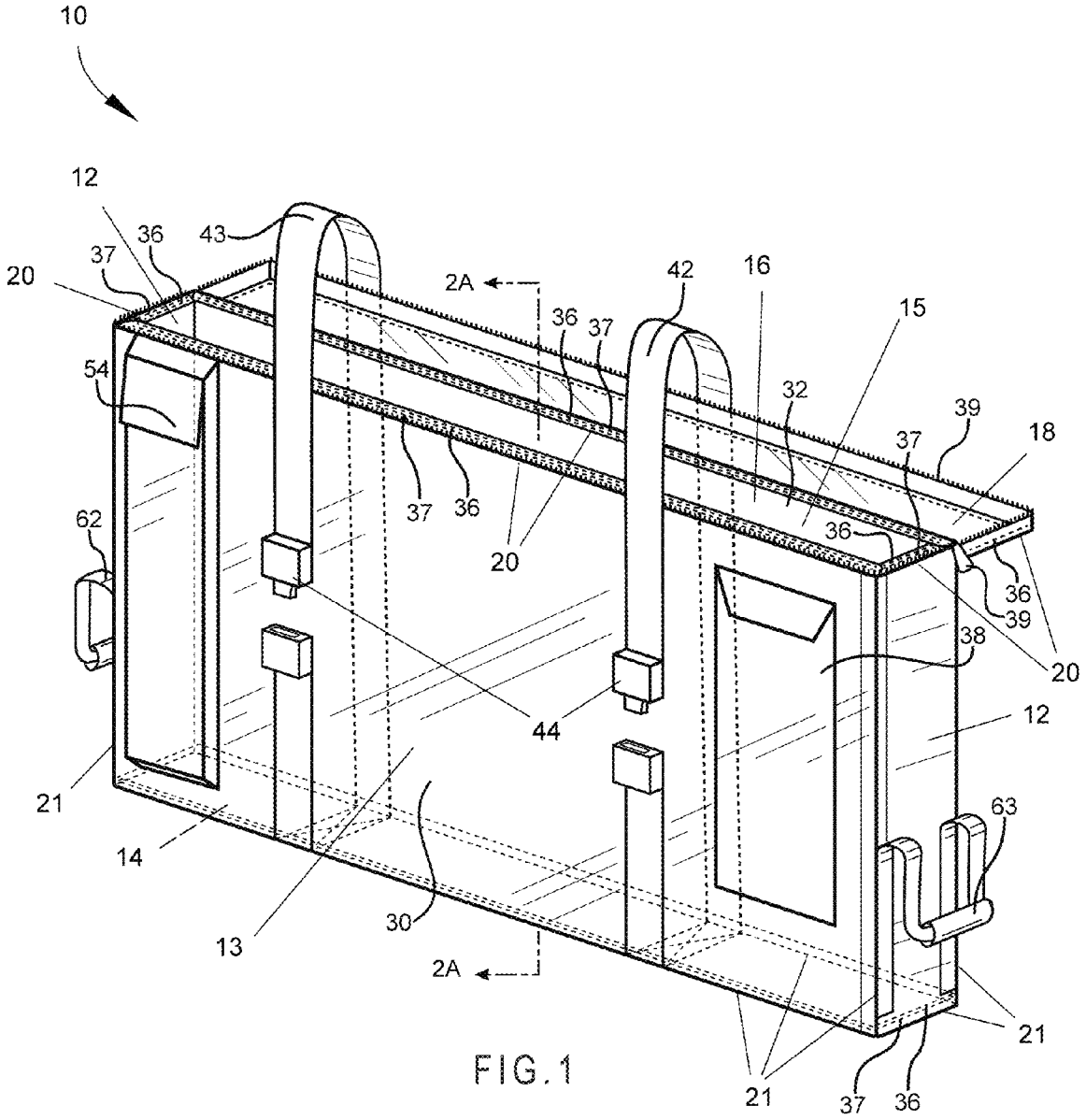
FIG. 1 is a perspective view representing a protective case in accordance with certain aspects of this invention.

FIG. 1 represents the protective case 10 configured for transportation of a fragile planar-shaped object. The case 10 comprises six rectangular walls including two side walls 12, a front wall 13, a bottom wall 14, a rear wall 15, and a closable lid 18 secured to at least one of the two side walls 12, the front wall 13, or the rear wall 15, defining in combination what can be referred to as a parallelepiped form or shape. The lid 18 is configured for closing an opening 16 at an uppermost location of the case 10 oppositely-disposed from the bottom wall 14 and defined by uppermost edges of the side walls 12, the front wall 13, and the rear wall 15. The five walls 12, 13, 14, and 15 and lid 18 are physically connected at edges thereof to define a parallelepiped-shaped housing having a cavity therein that is sized and shaped for containing and enclosing a planar-shaped object.

Figure 2B:
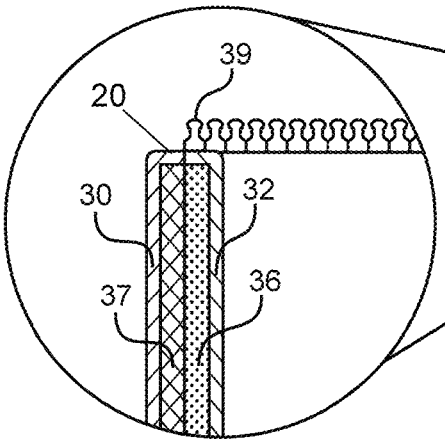
FIGS. 2B and 2C are detailed views of portions of the protective case shown in FIG. 2A.
Figure 2A:
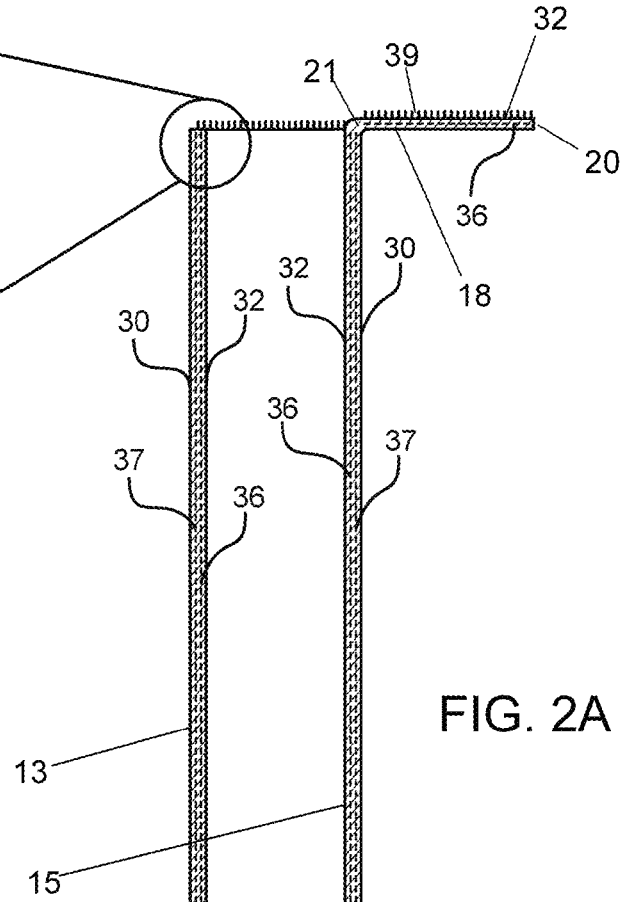
FIG. 2A represents a cross-sectional view of the protective case of FIG. 1 along section line 2A-2A.

Each of the walls 12, 13, 14, and 15 and lid 18 comprises a multilayer structure including an external layer 30 and an internal layer 32. Preferably, the walls 12, 13, 14, and 15 and lid 18 are defined by an integral sewing and stitching of material such that the external layer 30 and the internal layer 32 are continuous throughout each wall 12, 13, 14, and 15 and lid 18, thereby promoting the durability of the case 10. FIG. 2A represents a cross-sectional view illustrating the front wall 13, bottom wall 14, rear wall 15, and lid 18 of the case 10. As represented, the exterior and interior layers 30 and 32 of the walls 13, 14, and 15 and lid 18 have one or more protective layers disposed and secured therebetween. Though not shown, the side walls 12 of the case 10 may also comprise one or more protective layers disposed and secured between their exterior and interior layers 30 and 32. Each of the individual walls 12, 13, 14, and 15 and lid 18 may comprise any number of protective layers within their exterior and interior layers 30 and 32.

Figure 2C:
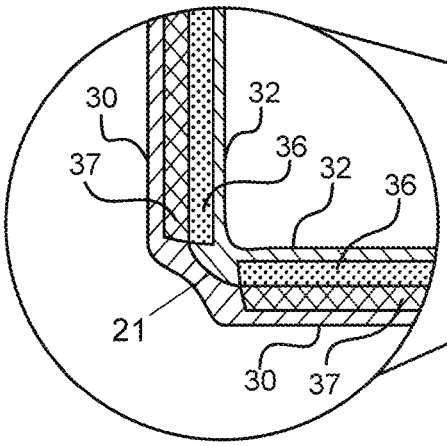
Figure 2C:
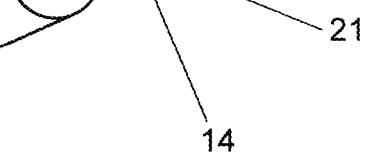

The term "protective layer" as used herein encompasses "impact-absorbing" layers and "rigid" layers. An impact-absorbing layer is functionally capable of protecting a planar-shaped object from damage due to drops and the like, and a rigid layer is functionally capable of maintaining the rigidity of the case 10 during transport and storage in the event of an impact that might otherwise damage a planar-shaped object within the case 10. As represented in FIGS. 2A, 2B and 2C, at least the front wall 13, bottom wall 14, and rear wall 15 preferably include an impact-absorbing layer 36 and a rigid layer 37 located between the impact-absorbing layer 36 and its exterior layer 30. Each side wall 12 also preferably includes an impact-absorbing layer 36 and a rigid layer 37 located between the impact-absorbing layer 36 and its exterior layer 30. Preferred rigid layers 37 are defined by a single planar panel that covers substantially the entirety of the wall in which it is included and has a thickness and hardness suitable for limiting the flexibility of the wall 12, 13, 14 and 15 in which it is included. By including the rigid layer 37 in at least the side walls 12, front wall 13, bottom wall 14, and rear wall 15, the enhanced rigidity of these walls 12, 13, 14, and 15 may serve to reinforce one another and limit movement of any one of the walls 12, 13, 14, and 15 when an external force is applied to the case 10. The majority of an externally applied force is preferably distributed among the rigid layers 37 of the walls 12, 13, 14, and 15 rather than applied to a planar-shaped object stored within the case 10, thereby reducing the likelihood that the planar-shaped object will become damaged if an impact, twist, or other force is applied to the case 10. Although FIG. 2A represents the lid 18 as including the impact-absorbing layer 36 as the sole protective layer, it may be desirable to further include the rigid layer 37 in the lid 18, depending on the application.

The individual protective layers may be formed of various materials known in the art. Relative to the rigid layer 37, the impact-absorbing layer 36 is preferably a more energy-absorbing cushioning material, such as a polymer foam that is sufficiently thick to protect the planar-shaped object from a predetermined level of impact, which will depend on the weight, size and type of planar-shaped object and can be ascertained through experimentation. Relative to the impact-absorbing layer 36, the rigid layer 37 is preferably a more solid, rigid material than the impact-absorbing layer 36, for example, a suitably thick, solid polymer material sufficient to limit the flexibility of the wall 12, 13, 14 and 15 of the case 10 in which it is included. According to an exemplary aspect of the invention, the impact-absorbing layer 36 comprises a polystyrene foam.

Figure 5:
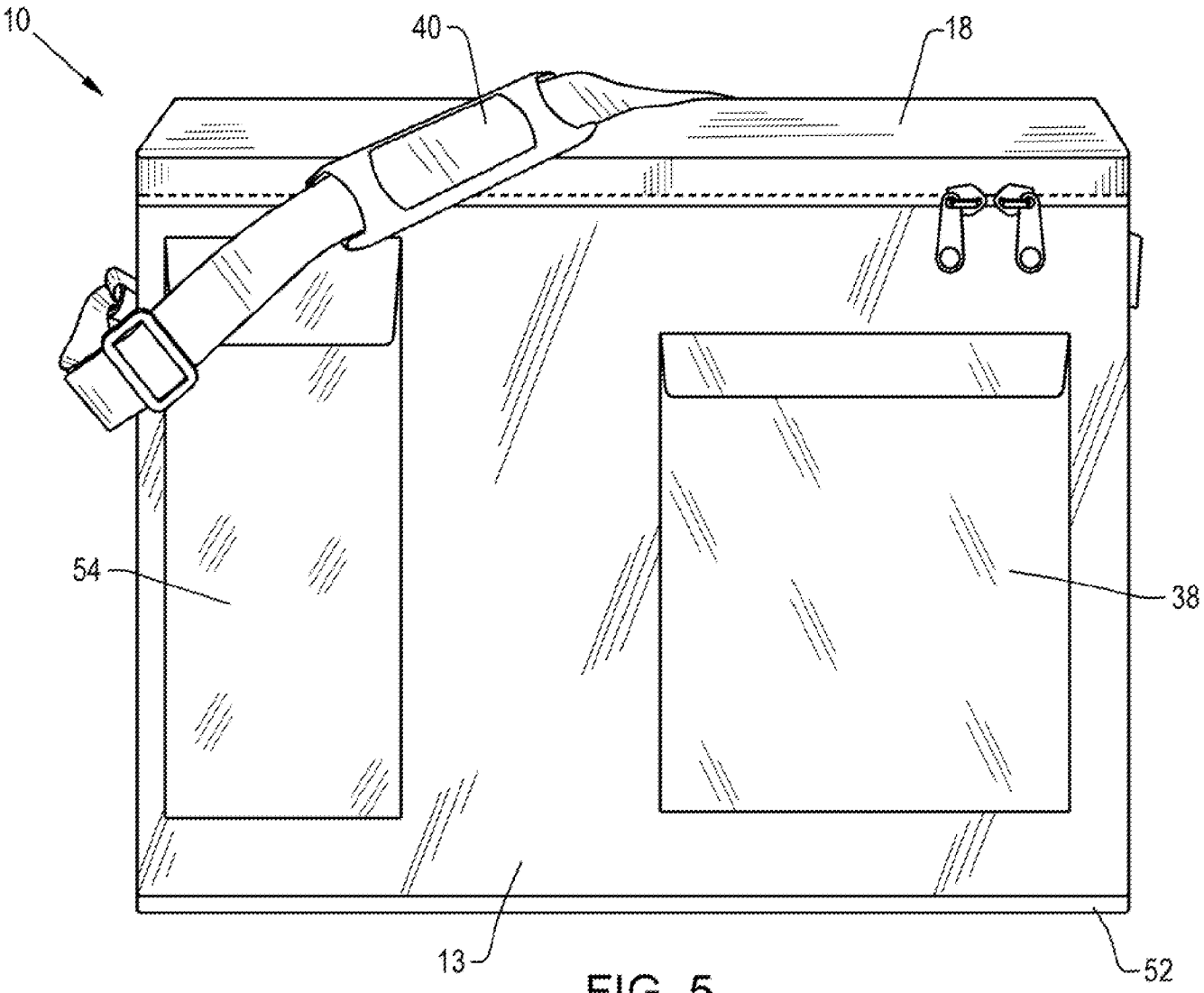

FIGS. 2B and 2C represent detailed views showing, respectively, an upper end portion 20 of the front wall 13 and a corner 21 defined by and between the front and bottom walls 13 and 14. The end portion 20 is representative of other end portions of the side walls 12, front wall 13, and lid 18, and the corner 21 is representative of other corners of the case 10 defined by and between adjoining pairs of the side, front and bottom walls 12, 13 and 14 and lid 18. The exterior layer 30 and the interior layer 32 are secured to one another at the end portions 20 and corners 21, for example, with stitching 52 (FIG. 5) adjacent the edges of the impact-absorbing and rigid layers 36 and 37, which preferably do not meet at the corners 21. Such construction secures the impact-absorbing and rigid layers 36 and 37 in desired locations within the walls 12, 13, 14, and 15 and lid 18, and promotes flexibility at the corners 21 of the case 10.

The exterior and interior layers 30 and 32 may be formed of various materials known in the art. Preferably, the exterior layer 30 comprises a durable material of the type commonly used for cases, cases, luggage, and the like, and the interior layer 32 comprises a material suitable for contact with the planar-shaped object and having properties which reduce the likelihood of damaging portions of the planar-shaped object that are susceptible to scratches, for example, a display screen of a flat-screen device. Preferred examples include exterior layers 30 formed of a thick, durable polyester-based fabric material and interior layers 32 formed of a smooth nylon and polyester-based sheet material.

Figure 3:
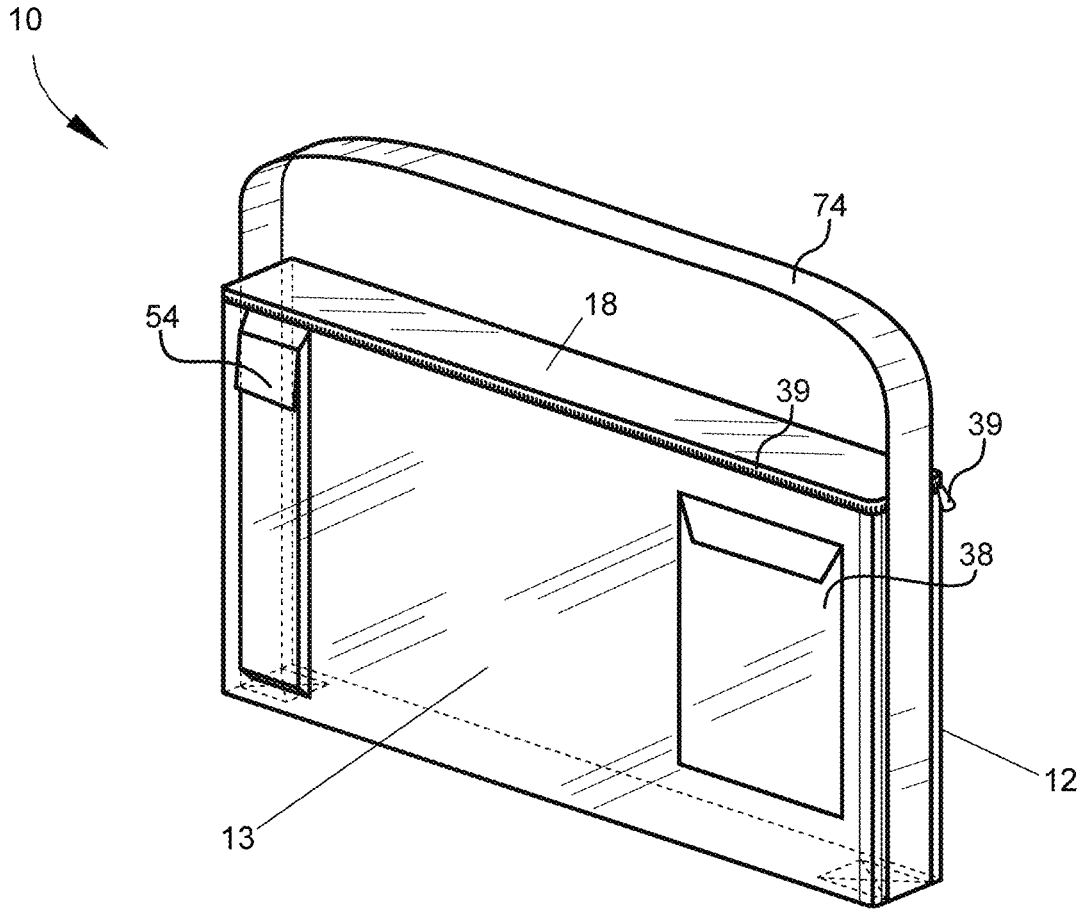
FIG. 3 is a perspective view representing a protective case in accordance with additional aspects of this invention.

The lid 18 may be sealed by various means known in the art. FIGS. 1-3 represent the lid 18 as configured to be releasably secured to uppermost edges of the side walls 12 and front wall 13 with a zipper 39. In addition, FIG. 1 represents the case 10 as comprising two straps 42 and 43 secured to the case 10, for example at the bottom wall 14, each having a first portion configured to be located along the rear wall 15 of the case 10, over the closed lid 18, and along the front wall 13 of the case 10 to couple with a second portion located along the front wall 13 of the case 10 to thereby secure the lid 18. Although FIG. 1 represents the first and second portions of each strap 42 and 43 as being configured to couple with snap-type buckles 44, it is within the scope of the invention that the first and second portions may be secured by various other known means.

FIG. 1 represents the case 10 as also comprising handles 62 and 63 located on the oppositely-disposed sidewalls 12 of the case 10. Alternatively or in addition, FIG. 3 represents the case 10 as comprising a shoulder strap 74. The case 10 may comprise the handles 62 and 63, shoulder strap 74, and/or any other means suitable for promoting the ease of carrying the case 10. Such carrying means may be adjustable, located on any portion of the case 10, and secured in any manner. For example, an adjustable strap 40 (FIG. 5) may be permanently or removably secured to oppositely-disposed ends of the case 10.

The case 10 may have a plurality of pockets located on and secured to the exterior layer 30 thereof, depending on the application of the case 10. These pockets may be of any shape, size, and construction. For example, FIGS. 1 and 3 represent the case 10 as comprising a transparent pocket 38 and a deep pocket 54 located on the front wall 13. Both pockets 38 and 54 are secured along edges thereof to the exterior layer 30 of the case 10, and include a flap located at uppermost portions of the pockets 38 and 54 that may be closed over an opening thereat and secured to an exterior of the pockets 38 and 54 with a suitable fastener, such as a complementary hook-and-loop closure material. The transparent pocket 38 is preferably formed of a relatively transparent polymer material stitched to the exterior layer 30 of the case 10 and reinforced with a fabric material along edges of the transparent pocket 38. The transparent pocket 38 is preferably sized and shaped to hold documents, for example, invoices or transfer paperwork that may be visible from the exterior of the case 10 when viewed through the transparent pocket 38. The deep pocket 54 is preferably formed of the same material as the exterior layer 30 and stitched to the exterior layer 30 of the case 10 along edges of the pocket 54. The pocket 54 may be configured to hold objects commonly transported with the planar-shaped object, such as electrical cords and monitor cords.

As the case 10 is configured to transport fragile planar-shaped objects, the case 10 may preferably include visual warnings located on its exterior indicating the type and/or properties of a planar-shaped object within its cavity. For example, the case 10 may include a warning written on a portion of the front wall 13 of the case 10 stating "HANDLE WITH CARE."

While the invention has been described in terms of specific embodiments, it is apparent that other forms could be adopted by one skilled in the art. For example, the case 10 could differ in appearance and construction from the embodiments shown in the Figures, the functions of each component of the case 10 could be performed by components of different construction but capable of a similar (though not necessarily equivalent) function, and appropriate materials could be substituted for those noted. Accordingly, it should be understood that the invention is not limited to the specific embodiments illustrated in the Figures. It should also be understood that the phraseology and terminology employed above are for the purpose of disclosing the illustrated embodiments, and do not necessarily serve as limitations to the scope of the invention. Therefore, the scope of the invention is to be limited only by the following claims.

The invention claimed is:

1. A protective case for transporting and storing a planar-shaped object, the protective case comprising:

a body including a first side wall, a second side wall spaced apart from the first side wall, a front wall, a rear wall spaced apart from the front wall, and a bottom wall coupled to the first and second side walls, front wall, and rear wall at edges thereof to define a parallelepiped-shaped housing having a cavity therein configured to receive the planar-shaped object;

an opening at an end of the body oppositely-disposed from the bottom wall and defined by uppermost edges of the first side wall, the second side wall, the front wall, and the rear wall; and a lid secured to at least one of the uppermost edges of the first side wall, the second side wall, the front wall, or the rear wall and configured to close the opening and secure the planar-shaped object within the cavity of the protective case;

wherein the first side wall, the second side wall, the front wall, the rear wall, the bottom wall, and the lid each comprise a multilayer construction including an exterior layer, an interior layer, and at least one protective layer enclosed therebetween, each of the protective layers comprises at least one impact-absorbing layer configured to cushion the planar-shaped object, the protective layers of the first side wall, the second side wall, the front wall, the rear wall, and the bottom wall comprising a rigid layer configured to increase the rigidity of the protective case;

wherein the exterior layer and the interior layer of each of the first side wall, the second side wall, the front wall, the rear wall, the bottom wall, and the lid are directly connected to each other at ends and corners of the protective case adjacent and between edges of the protective layers.

2. The protective case of claim 1, wherein the protective layers substantially cover an entirety of the first side wall, the second side wall, the front wall, the rear wall, the bottom wall, and the lid.

3. The protective case of claim 1, wherein adjacent edges of the impact-absorbing and rigid layers in the first side wall, the second side wall, the front wall, the rear wall, the bottom wall, and the lid do not directly contact one another at the corners of the protective case.

4. The protective case of claim 1, wherein the rigid layer of each of the first side wall, the second side wall, the front wall, the rear wall, and the bottom wall is located between the exterior layer and the impact-absorbing layer thereof.

5. The protective case of claim 1, wherein a majority of forces externally applied to the protective case are distributed among the rigid layers of the first side wall, the second side wall, the front wall, the rear wall, and the bottom wall rather than to the planar-shaped object within the cavity of the protective case.

6. The protective case of claim 1, further comprising a transparent pocket secured to an exterior surface of the exterior layer of at least one of the first side wall, the second side wall, the front wall, the rear wall, the bottom wall, and the lid, the transparent pocket being configured to store and display written documents.

7. The protective case of claim 1, further comprising a pocket secured to an exterior surface of the exterior layer of at least one of the first side wall, the second side wall, the front wall, the rear wall, the bottom wall, and the lid, the pocket being configured to store a power cord or computer monitor cord.

8. The protective case of claim 1, further comprising handles or a shoulder strap.

9. The protective case of claim 1, further comprising at least one strap for securing the lid to close the opening and secure the planar-shaped object within the cavity of the protective case.

10. The protective case of claim 1, wherein the exterior layer of each of the first side wall, the second side wall, the front wall, the rear wall, the bottom wall, and the lid is an integral sewing and stitching of material throughout the first side wall, the second side wall, the front wall, the rear wall, the bottom wall, and the lid.

11. The protective case of claim 1, wherein the internal layer of each of the first side wall, the second side wall, the front wall, the rear wall, the bottom wall, and the lid is an integral sewing and stitching of material throughout the first side wall, the second side wall, the front wall, the rear wall, the bottom wall, and the lid.

12. The protective case of claim 1, wherein the lid includes a rigid layer configured to increase the rigidity of the protective case.

13. The protective case of claim 1, wherein the planar-shaped object is within the cavity of the protective case and has a flat display screen that substantially covers at least one side of the planar-shaped object.

14. The protective case of claim 13, wherein the planar-shaped object is a flat-screen device.

15. A protective case having a cavity therein for transporting and storing a planar-shaped object, the protective case comprising:

a body including a first side wall, a second side wall spaced apart from the first side wall, a front wall, a rear wall spaced apart from the front wall, and a bottom wall coupled to the first and second side walls, front wall, and rear wall at edges thereof to define a parallelepiped-shaped housing and the cavity of the protective case therein that contains the planar-shaped object;

an opening at an end of the body oppositely-disposed from the bottom wall and defined by uppermost edges of the first side wall, the second side wall, the front wall, and the rear wall; and a lid secured to at least one of the uppermost edges of the first side wall, the second side wall, the front wall, or the rear wall and configured to close the opening and secure the planar-shaped object within the cavity of the protective case;

wherein the first side wall, the second side wall, the front wall, the rear wall, the bottom wall, and the lid each comprise a multilayer construction including an exterior layer, an interior layer, and at least one protective layer enclosed therebetween, each of the protective layers comprises at least one impact-absorbing layer configured to cushion the planar-shaped object, the protective layers of the first side wall, the second side wall, the front wall, the rear wall, and the bottom wall comprising a rigid layer configured to increase the rigidity of the protective case;

wherein a majority of a force externally applied to the case is distributed among the rigid layers of the first side wall, the second side wall, the front wall, the rear wall, and the bottom wall rather than to the planar-shaped object;

wherein the exterior layer and the interior layer of each of the first side wall, the second side wall, the front wall, the rear wall, the bottom wall, and the lid are directly connected to one another at ends and corners of the protective case adjacent and between edges of the protective layers.

16. The protective case of claim 15, wherein the protective layers substantially cover an entirety of the first side wall, the second side wall, the front wall, the rear wall, the bottom wall, and the lid.

17. The protective case of claim 15, wherein adjacent edges of the impact-absorbing and rigid layers in the first side wall, the second side wall, the front wall, the rear wall, the bottom wall, and the lid do not directly contact each other at the corners of the protective case.

18. The protective case of claim 15, wherein the rigid layer of each of the first side wall, the second side wall, the front wall, the rear wall, and the bottom wall is located between the exterior layer and the impact-absorbing layer thereof.

19. The protective case of claim 15, wherein the exterior layer and the interior layer of each of the first side wall, the second side wall, the front wall, the rear wall, the bottom wall, and the lid are each an integral sewing and stitching of material throughout the first side wall, the second side wall, the front wall, the rear wall, the bottom wall, and the lid.

20. The protective case of claim 15, wherein the lid includes a rigid layer configured to increase the rigidity of the protective case.

* * * * *